US005695455A

United States Patent [19]

Alton, Jr. et al.

[11] Patent Number: 5,695,455

[45] Date of Patent: Dec. 9, 1997

[54] HYDRO-ACOUSTIC MASSAGE SYSTEM AND METHOD

[75] Inventors: Noyal John Alton, Jr.; Alan George Madsen, both of Virginia Beach, Va.

[73] Assignee: Sound Related Technologies, Inc., Virginia Beach, Va.

[21] Appl. No.: 535,976

[22] Filed: Sep. 29, 1995

[51] Int. Cl.[6] ..... A61H 23/00

[52] U.S. Cl. ..... 601/47; 601/55; 601/56; 601/148; 5/666; 5/674

[58] Field of Search ..... 601/47, 55, 56, 601/148; 5/666, 674, 904

[56] References Cited

U.S. PATENT DOCUMENTS

| | | | |
|---|---|---|---|
| 3,085,568 | 4/1963 | Whitesell | 601/55 |
| 4,507,816 | 4/1985 | Smith | 5/666 |
| 5,097,821 | 3/1992 | Eakin | 601/47 |
| 5,113,852 | 5/1992 | Murtonen | 601/47 |
| 5,314,403 | 5/1994 | Shaw | 601/55 X |

FOREIGN PATENT DOCUMENTS

| | | | |
|---|---|---|---|
| 465870 | 1/1992 | European Pat. Off. | 601/47 |

*Primary Examiner*—Dante D. DeMille
*Attorney, Agent, or Firm*—Peter J. Van Bergen

[57] ABSTRACT

A massage apparatus includes a flexible bladder filled with a fluid and a plurality of bladder displacement devices coupled to the flexible bladder for displacing the flexible bladder in accordance with a specified displacement plan. A signal source is coupled to the bladder displacement devices to provide the specified displacement plan. The signal source outputs first and second frequency modulated (FM) signals. The FM signals are identical in spectrum and start at zero phase, but are propagated 180° out-of-phase with respect to one another. The first FM signal is fed to one half of the bladder displacement devices and the second FM signal is fed to the other half of bladder displacement devices. The FM signals are controlled in such a way that vibrational energy travels in the fluid-filled bladder for coupling to a user reclined on the bladder while ambient vibration of the apparatus is canceled.

17 Claims, 3 Drawing Sheets

FM SIGNAL SOURCE
t=0
t=0
$l_z$
10
11
12
14
16
18
20
30
40
41
42
50
51
52
100
140
141
142
143
144
145
200

200
10
11
12
145
140
144
143
141
142
14
16
18
20
$l_z$
40
41
42
50
51
52
t=0
60
70
A
T/2
T
t
FM SIGNAL SOURCE
30

HYDRO-ACOUSTIC MASSAGE SYSTEM AND METHOD

FIELD OF THE INVENTION

The invention relates generally to massage devices, and more particularly to a massage system and method that couples acoustic energy to a fluid-filled bladder with which a person's body is in contact.

BACKGROUND OF THE INVENTION

The damage caused by stress in our society is well known. More than ever, people are recognizing that excess stress leads to discomfort, disease, and diminished productivity. In fact, research indicates that every disease from cancer to the common cold is adversely affected by heightened stress. Finding ways to combat stress, or the harmful effects of the stress that will always be experienced, is becoming increasingly important to our society.

A variety of electromechanical massage devices are available commercially for reducing muscle tension brought on by stress, injury or a combination thereof. However, the vast majority of these devices are hand-held and, therefore, are only capable of addressing muscle tension on a localized basis. Furthermore, the hand-held nature of these devices requires operation by a massage technician or therapist, or requires that the user massage himself/herself. The cost and inconvenience associated with requiring a massage therapist often makes this option unattractive to many people. However, requiring the user to massage himself/herself can be counterproductive in that the effort and energy required to perform the massage may add to the stress or injury that one is attempting to remedy.

SUMMARY OF THE INVENTION

Accordingly, it is an object of the present invention to provide a method and system that effectively achieves a full-body massage.

Another object of the present invention is to provide a massage method and system that efficiently couples massage energy to the human body.

Other objects and advantages of the present invention will become more obvious hereinafter in the specification and drawings.

In accordance with the present invention, a massage apparatus includes a water-filled mattress supported by a rigid frame. The rigid frame defines a plurality of enclosures beneath the water-filled mattress. Each enclosure incorporates the water-filled mattress to define a sealed chamber filled with air immediately beneath the water-filled mattress. An acoustic driver is mounted in each enclosure in driving communication with the air in a corresponding one of the sealed chambers. A signal source is coupled to each acoustic driver. The signal source outputs a first frequency modulated (FM) signal and a second FM signal identical in spectrum to the first FM signal. The first and second FM signals start at zero phase and propagate 180° out-of-phase with respect to one another. The first FM signal is fed in its original waveform to a first of the acoustic drivers and is fed 180° out-of-phase with respect to its original waveform to a second of the acoustic drivers. The second FM signal is fed in its original waveform to a third of the acoustic drivers and is fed 180° out-of-phase with respect to its original waveform to a fourth of the acoustic drivers. The gains of the first and second FM signals can be adjusted to cause the vibrational energy delivered to the water-filled mattress to pan along the length of and/or across the width of the water-filled mattress.

DETAILED DESCRIPTION OF THE INVENTION

Figure 1:
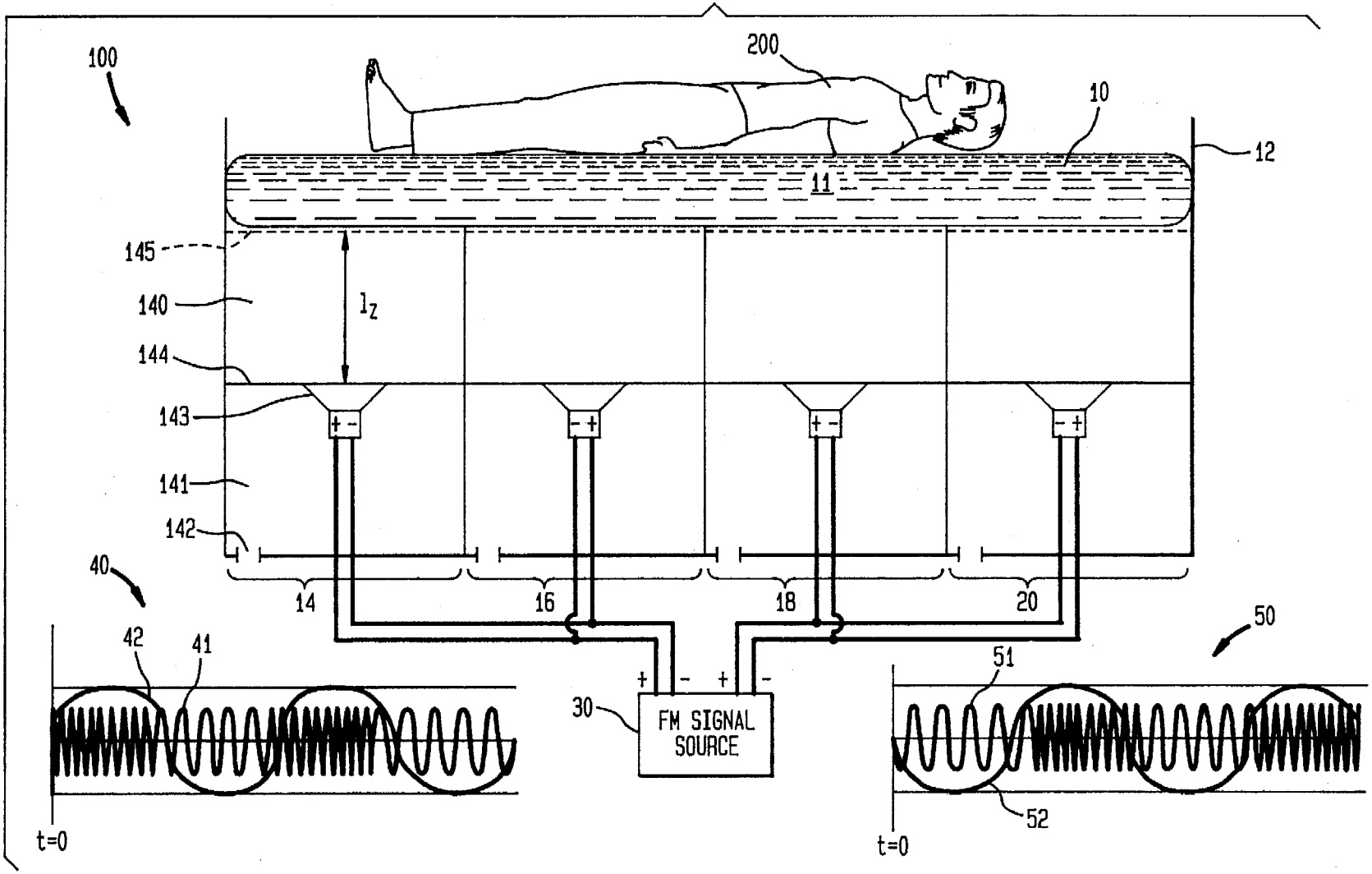
FIG. 1 is a schematic view of one embodiment of the hydro-acoustic massage system according to the present invention.

Referring now to the drawings, and more particularly to FIG. 1, one embodiment of a hydro-acoustic massage system according to the present invention is shown and referenced generally by numeral 100 with user 200 reclined thereon. Although shown configured as a full-body supportive bed, system 100 could also be implemented in the form of a reclining chair or can be downsized to support individual limbs of the user.

System 100 includes fluid-filled flexible bladder 10 resting on or supported by rigid frame 12. Bladder 10 is any conventional, fluid-retaining flexible bladder such as a water-bed mattress. Bladder 10 is typically filled with liquid 11 such as water that is heated to a comfortable temperature typically in the range of 90°–95° F. as is the case with conventional waterbeds. Frame 12 is any rigid frame constructed from a dense material such as plywood, particle board or other laminate composite. As shown, frame 12 provides a free-standing support for bladder 10. Defined within or by frame 12 are a plurality of individual enclosures. For purpose of the present invention, the number of enclosures defined within or by frame 12 is four or some multiple thereof. For purpose of illustration, only four of such enclosures are shown and referenced by numerals 14, 16 18 and 20. Additional sets of four enclosures and associated components can be added in accordance with the following description as will be readily apparent to one skilled in the art.

Since the structure of each enclosure 14, 16, 18 and 20 are typically identical, only enclosure 14 and its associated components will be discussed herein. Enclosure 14 is constructed similarly to the loudspeaker enclosure described in U.S. Pat No. 5,281,777, which is incorporated herein by reference. Briefly, enclosure 14 operates in combination with a portion of bladder 10 to define air-tight upper chamber 140. Enclosure 14 also defines lower chamber 141 having port 142 that is open to the surrounding environment. For best damping effects, port 142 preferably faces down to a padded or carpeted floor (not shown) on which frame 12 would rest. Similar to loudspeaker enclosures, the entire enclosure structure is rigidly constructed. The side walls of adjacent ones of enclosures 14, 16, 18 and 20 can be shared (as shown) or spatially separated from the side walls of adjacent enclosures.

A pressure driver, e.g., acoustic driver or loudspeaker 143, is mounted in wall 144. In combination with loudspeaker 143, wall 144 separates and seals upper chamber 140 from lower chamber 141. As shown, loudspeaker 143 is mounted directly opposite bladder 10 to radiate upward into upper chamber 140. The distance between loudspeaker 143 and bladder 10 is defined as $l_z$. The portion of bladder 10 over enclosure 14 is supported and maintained at the height $l_z$ above loudspeaker 143 by a flexible lattice represented by dashed lines 145. Lattice 145 has a plurality of perforations (not shown) for allowing sound pressure generated by loudspeaker 143 to pass therethrough. Lattice 145 is fixed to and supported at the side walls of enclosure 14. Lattice 145 is constructed from a dense material such as marine-grade plywood. It has been found experimentally that $l_z$ is equal to approximately one half of the diameter of loudspeaker 143.

Enclosure 14 with loudspeaker 143 serves to displace the portion of bladder 10 above enclosure 14 in the following manner. When excited, loudspeaker 143 generates sound pressure waves of equal and opposite magnitude into both upper chamber 140 and lower chamber 141. With respect to upper chamber 140, the waves impinge upon and pass through lattice 145. The underside of bladder 10 receives the waves and transmits same through liquid 11. The waves propagate through liquid 11 and are coupled to user 200. Because of the high percentage of water in the body of user 200, most of the vibrational energy is absorbed by user 200 so that very little of the energy is reflected by user 200.

The loudspeakers associated with each of enclosures 14, 16, 18 and 20 are excited in the following manner. Frequency modulated (FM) signal source 30 provides two FM signals that are identical in spectrum, that are at zero phase at start-up, and that are propagated 180° out-of-phase with one another. These two FM signals are represented graphically in FIG. 1 and are referenced generally by numerals 40 and 50. FM signal 40 can be modeled as carrier wave 41 modulated by modulating wave 42. Similarly, FM signal 50 can be modeled by carrier wave 51 modulated by modulating wave 52 except that modulating wave 52 is swept 180° out-of-phase with respect to the sweep of modulating wave 42.

The present invention displaces bladder 10 in accordance with a specified plan of vibrational waves while employing phase cancellation to limit the ambient vibration of frame 12 to include enclosures 14, 16, 18 and 20. More specifically, the speakers associated with enclosures 14 and 16 are connected to FM signal source 30 to respectively receive FM signal 40 in its original waveform and 180° out-of-phase with respect to its original waveform. Similarly, the speakers associated with enclosures 18 and 20 are connected to FM signal source 30 to respectively receive FM signal 50 in its original waveform and 180° out-of-phase with respect to its original waveform. Vibrational energy is focused on bladder 10 while the phase cancellation aspect of the present invention dampens vibrations of frame 12 and, therefore, the surrounding environment as well. This allows user 200 to receive the full benefit of the vibrational energy coupled to liquid 11 in bladder 10 while not experiencing unwanted environmental resonance.

Figure 2:
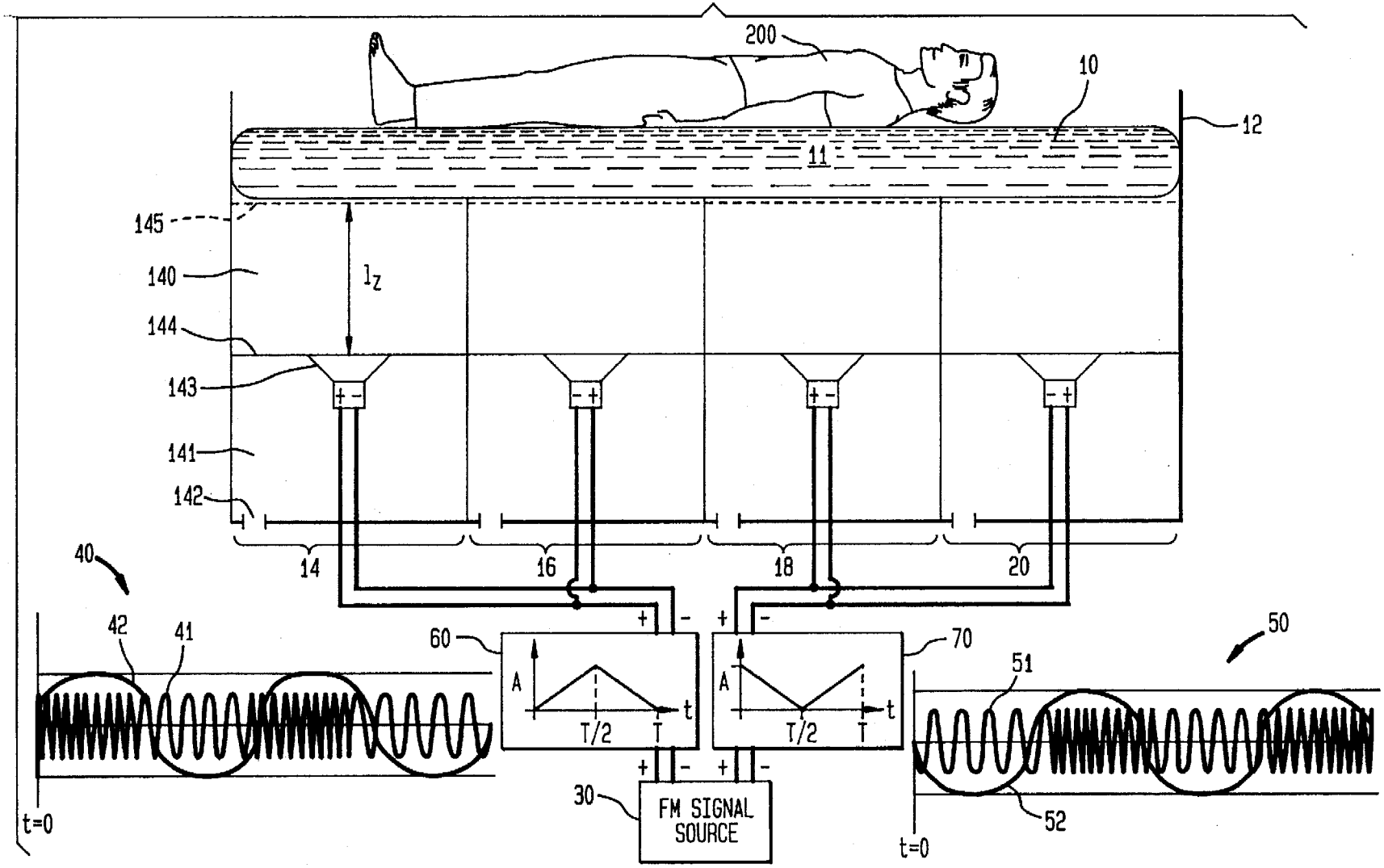
FIG. 2 is a schematic view of another embodiment of the hydro-acoustic massage system.

The effects of the present invention can be further enhanced by panning the vibrational wave energy along the length of bladder 10. This is accomplished by adjusting the gains of FM signals 40 and 50 as shown in the embodiment of FIG. 2 where like reference numerals are used for those elements common with the embodiment of FIG. 1. In FIG. 2, FM signal 40 is processed by amplitude envelope 60 and FM signal 50 is processed by amplitude envelope 70. Each of amplitude envelopes 60 and 70 employs a time-varying gain function. The gain functions are linear functions and are selected to be complementary to one another as a function of time. By doing so, the effects of FM signals 40 and 50 are cross-faded thereby giving user 200 the sensation that the vibrational effects are panned along the length of bladder 10.

In terms of the present invention, FM signals 40 and 50 are in the low frequency range at or below 40 Hz. The low frequency vibrational energy couples efficiently to skin, muscle, bone and internal organs of the user's body for an enhanced therapeutic effect. In addition, since the FM signals used by the present invention generally occur in the inaudible range of humans, the therapeutic effects of the present invention can be enjoyed while listening to one's favorite music, poetry, or other soothing sound.

The advantages of the present invention are numerous. Low frequency vibrational energy is amplified and accelerated only through the fluid of the fluid-filled bladder for a high degree of coupling to the (mostly fluid) human body. Phase cancellation techniques are used to limit or eliminate ambient vibration.

Figure 3:
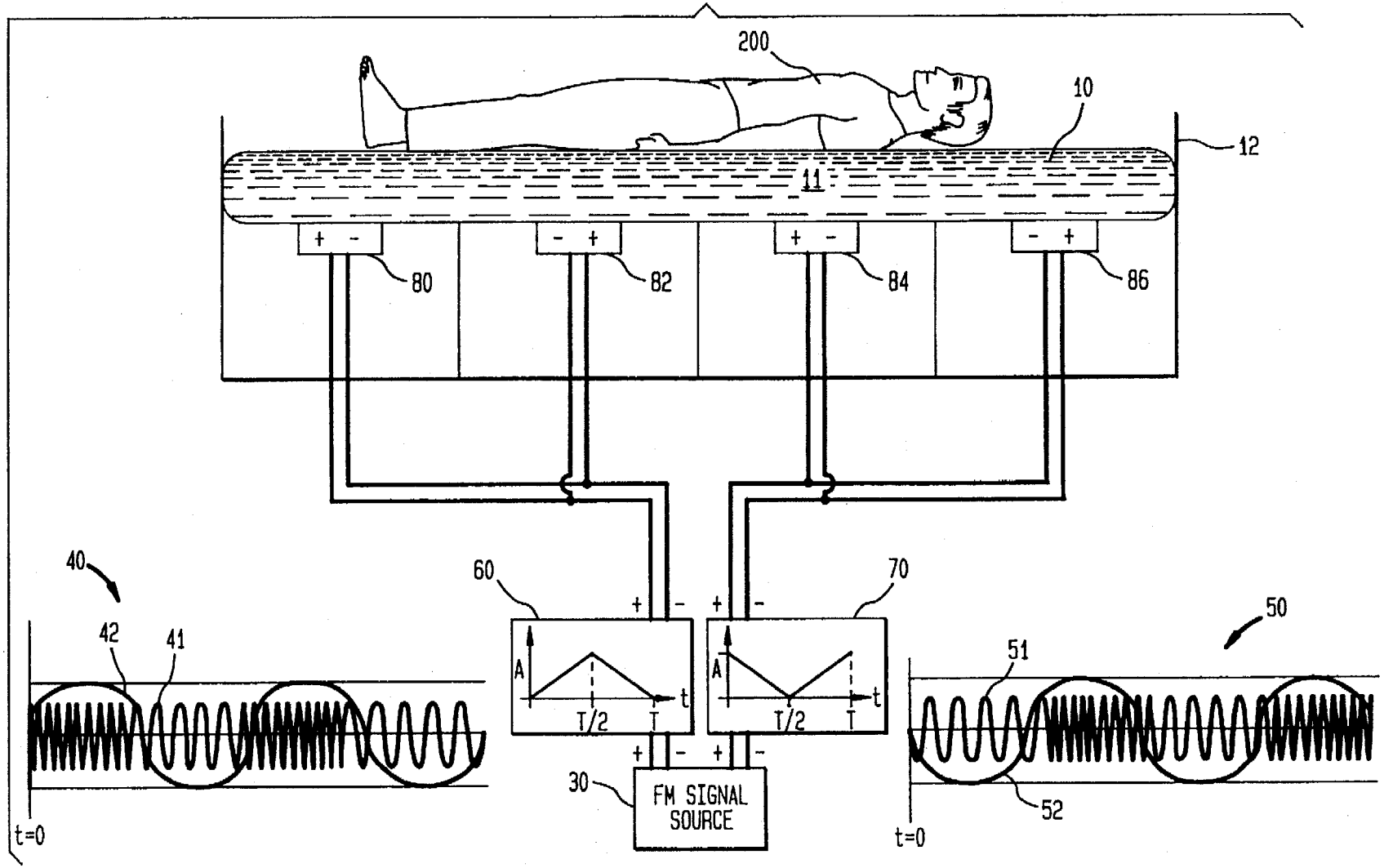
FIG. 3 is a schematic view of a hydro-acoustic massage system of the present invention that uses electromechanical transducers coupled directly to the fluid-filled bladder.

Although the present invention has been described relative to specific embodiments, it is not so limited. For example, as shown in FIG. 3, the enclosures and loudspeakers could be replaced by a plurality of electromechanical transducers 80, 82, 84 and 86, each of which is in direct contact with bladder 10 for coupling vibrational wave energy to bladder 10. Each transducer would be connected to one of amplitude envelopes 60 and 70 in an analogous fashion to that described above for the loudspeakers associated with enclosures 14, 16, 18 and 20 in FIG. 2.

Furthermore, although the enclosure/speaker combinations in the embodiments of FIGS. 1 and 2, and the transducers in the embodiment of FIG. 3, are shown placed along the length of bladder 10, this need not be the case. For example, the present invention can be configured so that bladder displacement pans across bladder 10 in addition to or alternatively to being panned along the length of bladder 10.

Thus, there are numerous variations and modifications that will be readily apparent to those skilled in the art in light of the above teachings. It is therefore to be understood that, within the scope of the appended claims, the invention may be practiced other than as specifically described.

What is claimed as new and desired to be secured by Letters Patent of the United States is:

1. An apparatus comprising:

a flexible bladder filled with a fluid;

a plurality of bladder displacement devices coupled to said flexible bladder for displacing said flexible bladder in accordance with a specified plan; and a signal source coupled to said plurality of bladder displacement devices for providing said specified plan, said specified plan utilizing a first frequency modulated (FM) signal and a second FM signal identical in spectrum to said first FM signal, said second FM signal swept 180° out-of-phase with respect to said first FM signal, said first FM signal and said second FM signal being applied alternately to pairs of adjacent ones of said plurality of bladder displacement devices wherein, for each of said pairs, a first bladder displacement device is coupled to said signal source to receive in-phase a respective one of said first FM signal and said second FM signal and a second bladder displacement device is coupled to said signal source to receive 180° out-of-phase said respective one of said first FM signal and said second FM signal.

2. An apparatus as in claim 1, wherein each of said plurality of bladder displacement devices comprises:

a rigid enclosure coupled to said flexible bladder such that said flexible bladder combines with said rigid enclosure to define a sealed chamber therebetween filled with a gas; and a pressure driver mechanically coupled to said sealed chamber and electrically coupled to said signal source, wherein said pressure driver affects pressure of said gas contained in said sealed chamber when said pressure driver has one of said first FM signal and said second FM signal applied thereto.

3. An apparatus as in claim 2, wherein said pressure driver is an acoustic driver.

4. An apparatus as in claim 1 further comprising:

a first amplitude envelope for processing said first FM signal, said first amplitude envelope defining a first time-varying gain function, said first amplitude envelope coupled between said signal source and said pairs receiving said first FM signal; and a second amplitude envelope for processing said second FM signal, said second amplitude envelope defining a second time-varying gain function that is the complement of said first time-varying signal, said second amplitude envelope coupled between said signal source and said pairs receiving said second FM signal.

5. An apparatus as in claim 1, wherein said first FM signal and said second FM signal do not exceed 40 Hz.

6. An apparatus as in claim 1, wherein each of said plurality of bladder displacement devices comprises an electromechanical transducer coupled directly to said flexible bladder.

7. An apparatus as in claim 1, wherein said plurality of bladder displacement devices comprises (4×N) bladder displacement devices where N is a whole number equal to or greater than 1.

8. An apparatus comprising:

a water-filled mattress;

a rigid frame supporting said water-filled mattress, said rigid frame defining a plurality of enclosures adjacent one another and aligned successively along the length thereof beneath said water-filled mattress;

each of said plurality of enclosures incorporating a portion of said water-filled mattress to define a sealed chamber filled with air immediately beneath said water-filled mattress;

an acoustic driver mounted in each of said plurality of enclosures to be in driving communication with the air in a corresponding one of said sealed chambers; and a signal source coupled to each said acoustic driver, said signal source supplying a first frequency modulated (FM) signal and a second FM signal identical in spectrum to said first FM signal and swept 180° out-of-phase with respect to one another, said first FM signal and said second FM signal applied alternately to pairs of adjacent ones of said plurality of bladder displacement devices wherein, for each of said pairs, a first said acoustic driver is coupled to said signal source to receive in-phase a respective one of said first FM signal and said second FM signal and a second said acoustic driver is coupled to said signal source to receive 180° out-of-phase said respective one of said first FM signal and said second FM signal.

9. An apparatus as in claim 8, wherein each of said plurality of enclosures further defines a ported chamber adjacent each said sealed chamber, each said ported chamber including a port leading to the ambient environment.

10. An apparatus as in claim 9, wherein each said port faces downward with respect to said rigid frame.

11. An apparatus as in claim 8, wherein each said acoustic driver is mounted directly opposite said water-filled mattress.

12. An apparatus as in claim 8, further comprising a lattice fitted in each of said plurality of enclosures and in direct contact with said water-filled mattress for supporting said water-filled mattress across each said sealed chamber.

13. An apparatus as in claim 8 further comprising:

a first amplitude envelope defining a first time-varying gain function, said first amplitude envelope coupled between said signal source and said pairs receiving said first FM signal; and a second amplitude envelope defining a second time-varying gain function that is the complement of said first time-varying signal, said second amplitude envelope coupled between said signal source and said pairs receiving said second FM signal.

14. An apparatus as in claim 8, wherein said first FM signal and said second FM signal do not exceed 40 Hz.

15. A method comprising the steps of:

providing a plurality of bladder displacement devices coupled to a fluid-filled bladder for displacing said fluid-filled bladder;

positioning said plurality of bladder displacement devices in a spaced-apart relationship along the length of said fluid-filled bladder;

providing a signal source of a first frequency modulated (FM) signal and a second FM signal identical in spectrum to said first FM signal, said second FM signal swept 180° out-of-phase with respect to said first FM signal;

coupling a first of said plurality of bladder displacement devices to said signal source to receive said first FM signal in-phase;

coupling a second of said plurality of bladder displacement devices adjacent said first of said plurality of bladder displacement devices to said signal source to receive said first FM signal 180° out-of-phase;

coupling a third of said plurality of bladder displacement devices adjacent said second of said plurality of bladder displacement devices to said signal source to receive said second FM signal in-phase; and coupling a fourth of said plurality of bladder displacement devices adjacent said third of said plurality of bladder displacement devices to said signal source to receive said second FM signal 180° out-of-phase.

16. A method according to claim 15 further comprising the steps of:

applying a first time-varying gain function to said first FM signal; and applying a second time-varying gain function to said second FM signal, wherein said second time-varying gain function is the complement of said first time-varying gain function.

17. A method according to claim 15, wherein said first FM signal and said second FM signal do not exceed 40 Hz.

* * * * *